US007607850B2

(12) United States Patent
Weckerle et al.

(10) Patent No.: US 7,607,850 B2
(45) Date of Patent: Oct. 27, 2009

(54) LIPSTICK FOR TWO COMPONENTS

(75) Inventors: Thomas Weckerle, Oberhausen (DE); Peter Obereisenbuchner, Peiβenberg (DE)

(73) Assignee: Weckerle GmbH, Weilheim (DE)

( * ) Notice: Subject to any disclaimer, the term of this patent is extended or adjusted under 35 U.S.C. 154(b) by 0 days.

(21) Appl. No.: 11/824,021

(22) Filed: Jun. 29, 2007

(65) Prior Publication Data

US 2008/0273916 A1 Nov. 6, 2008

(30) Foreign Application Priority Data

May 4, 2007 (EP) ..... 07 009 023

(51) Int. Cl.
*B43K 1/06* (2006.01)

(52) U.S. Cl. ..... 401/265

(58) Field of Classification Search ..... 401/261, 401/262, 265, 266, 17–19, 22, 28, 34, 35, 401/44–47

See application file for complete search history.

(56) References Cited

U.S. PATENT DOCUMENTS

| | | | | |
|---|---|---|---|---|
| 3,192,933 | A * | 7/1965 | Prince | 401/35 |
| 4,795,156 | A * | 1/1989 | Paulish | 273/148 R |
| 4,844,250 | A * | 7/1989 | Holoubek et al. | 222/107 |
| 4,887,924 | A * | 12/1989 | Green | 401/261 |
| 2006/0188315 | A1 | 8/2006 | Look et al. | |

OTHER PUBLICATIONS

European Search Report dated Oct. 26, 2007.

* cited by examiner

*Primary Examiner*—Huyen Le
(74) *Attorney, Agent, or Firm*—Howard & Howard Attorneys PLLC

(57) ABSTRACT

Apparatus (1) for optionally applying two components, with a body (2) comprising a first component for applying, wherein said body (2) comprises an opening (3) through which a second component for applying can be transported on said body (2).

5 Claims, 2 Drawing Sheets

LIPSTICK FOR TWO COMPONENTS

RELATED APPLICATION

This application claims priority to European Patent Application No. 07 009 023.8 filed May 4, 2007.

FIELD OF THE INVENTION

The present invention relates to a novel apparatus for optionally applying two components, in particular a lipstick with which a user can apply optionally at least two components on the lips.

BACKGROUND OF THE INVENTION

In general, lipsticks contain one component. In a known embodiment of a lipstick, the lipstick lead is made of this first component. By guiding the lipstick lead along a lip, this component is distributed on the lip. In an alternative known embodiment of a lipstick, the lipstick lead is made of a firm material, for example made of plastics. One side of this plastic lead has an opening which is connected with a reservoir. A component arranged in the reservoir is transported via the opening to the outside of the plastic lead and can be distributed on the lips by the user by means of the plastic lead.

There are different approaches to provide a lipstick with which multiple components, for example with different colors, can be applied. For example, this is achieved by a lipstick lead made of two components. For this, for example, one component is placed at the outside of the lipstick lead and the other component is placed at the inside. By differently placing the lipstick, the user can in some respect affect with which proportion the two components are distributed on the lip.

However, there is a fundamental need for an apparatus with which the user can optionally apply two components. Therefore, the present invention has the object to provide such an apparatus.

SUMMARY OF THE INVENTION

According to the invention, this object is solved by an apparatus according to independent claim 1. Advantageous embodiments arise from the dependent claims.

The apparatus according to the invention for optionally applying two components comprises a body made of a first component. This body made of the first component is for applying, that means the user can apply the first component for example on a lip. According to the invention, the body made of the first component comprises an opening. By means of this opening and through this opening, a second component can be transported to the outside of the body and can then be applied.

Due to the apparatus according to the invention, it is the first time possible for the user to optionally apply one of at least two components. The user can use the apparatus for applying the first component. The user can distribute the second component on the body through the opening of the body and can then apply the second component. Depending on the amount of the second component onto the body, it can be affected whether during the application of the first component, the second component or both components are applied. Consequently, an apparatus is provided with which the user can optionally apply one of at least two components or a combination of these at least two components.

According to a preferred embodiment of the present invention, the first component is such a firm component that the body can be made of this component. The second component is preferably made such that it can be transported on the body for the application. Therefore, in the following, a liquid component is assumed. However, the person skilled in the art knows that in general the transport is also possible with non-liquid components.

The apparatus comprises preferably a reservoir for the second component. This reservoir is preferably in connection with the opening of the body so that the second component can be transported from the reservoir to the body.

In order to enable a transport of the second component optionally, that means depending on the needs or the desire of the user, from the reservoir to the opening in the body, the apparatus comprises preferably suitable means. If a firm second component is used, the means can be a suitable sliding mechanism. In an alternative preferred embodiment, the reservoir comprises for this at least one deformable wall. By means of the deformable wall, the second component can be transported to the opening of the body when the user presses the deformable wall, like for example when a tube is used. The user can affect the amount of the transported second component by means of different pressure.

According to a preferred embodiment of the present invention, the apparatus according to the invention comprises also a lid. By means of this lid, the apparatus, in particular the body, is protected when the apparatus is not used. The lid comprises preferably means which are at least partially placed in the opening of the body when the lid is closed. This can be achieved, for example, by a stick which is placed at the inside of the lid and preferably is made out of the same material as the lid. By means of this stick, it can be secured that parts of the first or the second component are not stuck in the opening of the body and close thereby the body.

The apparatus according to the invention is preferably a lipstick with a body formed by the lipstick lead. However, the apparatus according to the invention can also be used for different purposes.

Further advantages and features of the present invention become apparent from the following detailed description in which the invention is described in more detail and in relation to the embodiments shown in the accompanying drawings.

DETAILED DESCRIPTION OF THE INVENTION

Figure 1:
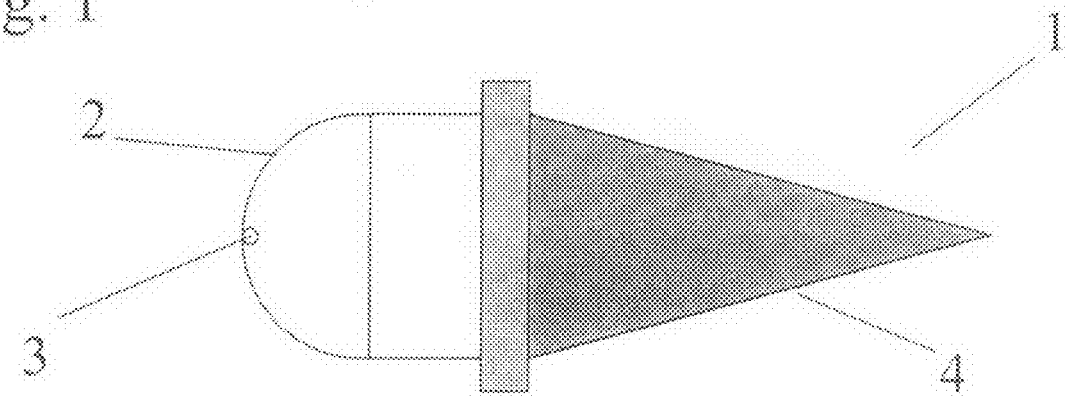
FIG. 1 shows an exterior view of a lipstick according to an embodiment of the present invention.

FIG. 1 shows exemplary the present invention by means of an embodiment of apparatus 1 formed by a lipstick. The apparatus 1 or the lipstick 1, respectively, comprises as body 2 a lipstick lead with an opening 3. This opening 3 is placed in this area of the lipstick lead 2 which comes into contact with the lips when the lipstick is used. For the illustration, an embodiment is shown in which the lipstick lead has a semi-circular design at the front side that means at the side which comes into contact with the lips when the lipstick is used. However, in general, it is possible that the lipstick lead has a different design.

The lipstick lead 2 is made of a first component. This first component consists of one material or one material composition, which is suitable and determined for being applied on a lip. The lipstick lead 2 preferably comprises a circular cross section and has preferably a diameter in the dimension of 7 to 35 mm. The opening 3 in the lipstick lead 2 has preferably a diameter of 1 to 5 mm. In general, the design and the proportions of the lipstick lead 2 or of the body, respectively, and of the opening 3 can be freely chosen depending on the usage of the apparatus according to the invention and depending on the used components.

Figure 2:
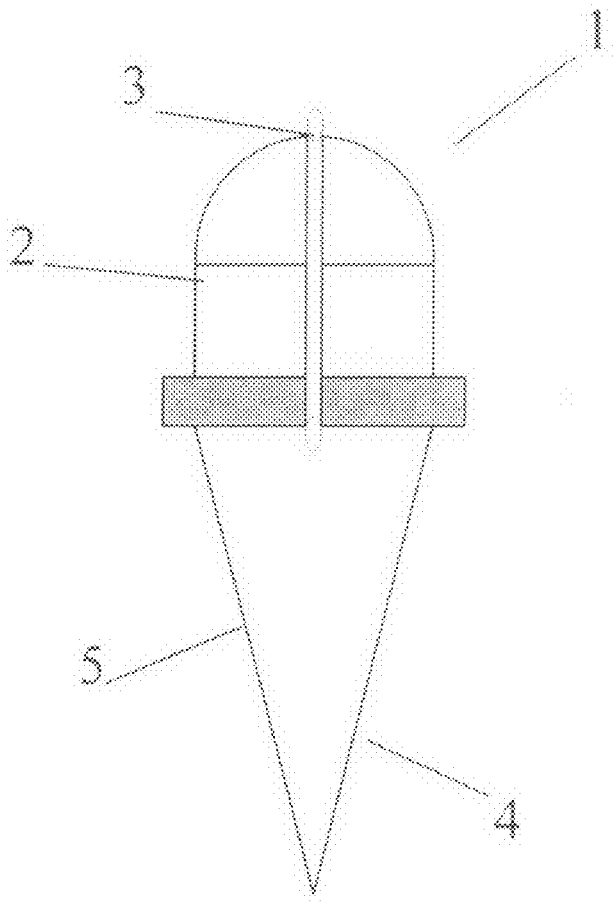
FIG. 2 shows a cross view through the embodiment of the lipstick shown in FIG. 1.

The lipstick 1 further comprises a reservoir 4 in which the second component can be stored. Therefore, the reservoir 4 is preferably in connection to the opening 3. FIG. 2 shows an example of how such a connection can look. In this case, the reservoir 4 is placed directly beside the lipstick lead 2 and therewith at the backside opening 3 of the lipstick lead 2.

Among other things, dependent on the consistence of the second component, different reservoirs 4 and different means for transporting the second component from the reservoir 4 to the opening 3 are possible. In the embodiment described herein for the purpose of illustration, a liquid second component is assumed. The second component is stored in the reservoir 4 which has in this embodiment the design of a tube. The tube has the advantage that it comprises a deformable wall 5 so that pressing the wall 5 moves the second component into the direction of the opening 3 in the lipstick lead 2. Depending on the pressure applied on the tube, the user of the lipstick according to the invention can choose which component or components she wants to distribute on the lips. With no or very low pressure, the second component stays in the reservoir so that only the first component is distributed on the lip. With more pressure, the second component is transported through the opening 3 of the lipstick lead 2 to the front of the lipstick lead 2 and can there be distributed on the lip together with the first component. Since the second component is distributed on the lipstick lead, it is possible to choose whether the first component comes into contact with the lip at all.

The dimension of the opening 3 in the lipstick lead 2 depends in general on the used first and second components. When the components are chosen, it should be considered that the opening 3 in the lipstick lead 2 does not stick so that the functionality of the lipstick according to the invention is not affected.

Figure 3:
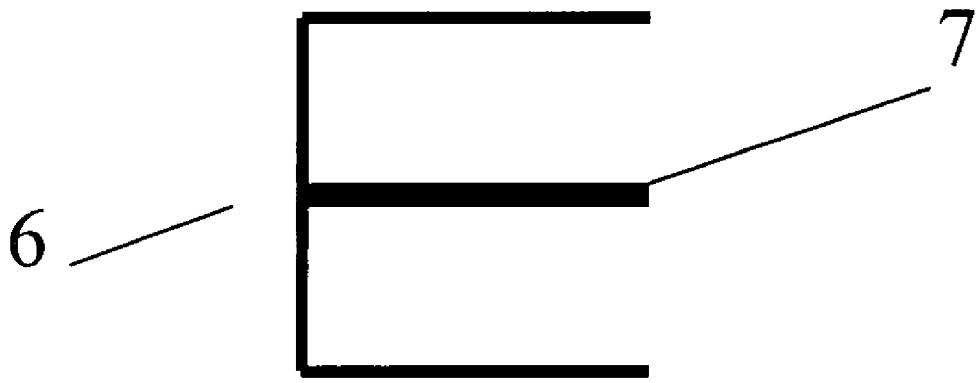
FIG. 3 shows a cross view of an embodiment of a lid of the lipstick according to the invention.

FIG. 3 shows a cross view of a preferred embodiment of the lid 6 of the lipstick 1 according to the invention. In this embodiment, the lid 6 comprises at the inner side means 7 which are at least partially placed in the opening 3 of the lipstick lead 2, when the lid 6 is closed. In FIG. 3, this means 7 is shown in the design of a stick. In principle also other designs for this means 7 are possible. When the lid 6 is closed, the means 7 is introduced into the opening 3 of the lipstick lead 2 so that the opening is released of leftovers of the first and second components. At the inner side of the opening 3 in the lipstick lead 2, there could be also placed another, for example, firmer component which prevents a closing of the opening.

Consequently with the present invention, an apparatus is provided the first time with which the user can simply optionally apply two components.

The invention claimed is:

1. An apparatus for selectively applying two cosmetic components to a human body, comprising:

a first cosmetic component comprising a solid composition for application to a human body, said first cosmetic component having an opening extending therethrough; a reservoir comprising a second cosmetic component being transportable from said reservoir through said opening extending through said first cosmetic component to a surface of said first cosmetic component thereby providing selection between application of said first cosmetic component or said second cosmetic component for selective application to the human body by selectively forcing said second cosmetic component from said reservoir th rough said opening extending through said first cosmetic body.

2. The apparatus set forth in claim 1, wherein said first cosmetic component comprises lip stick lead and said second cosmetic component comprises lipstick having a different composition from said first cosmetic component.

3. The apparatus set forth in claim 1, wherein said reservoir comprises a tube being adapted to transport said second cosmetic component through said opening extending through said first cosmetic component to said surface of first cosmetic component.

4. The apparatus set forth in claim 1, wherein said tube comprises a deformable wall thereby enabling said second cosmetic component to be forced through said opening extending through said first cosmetic component to said surface of said first cosmetic component.

5. The apparatus set forth in claim 1, comprising a lid having an inner side means at least partially placeable into said opening extending through said first cosmetic component thereby sealing said reservoir.

* * * * *